US007934675B2

(12) United States Patent
Mailyan et al.

(10) Patent No.: US 7,934,675 B2
(45) **Date of Patent: *May 3, 2011**

(54) SPLICING APPARATUS AND METHOD

(75) Inventors: Vartan Mailyan, Battle Ground, WA (US); Dennis A. Bradshaw, Clackamas, OR (US); Jorge A. Nash, Vancouver, WA (US); William W. Maness, Vancouver, WA (US)

(73) Assignee: Adalis Corporation, Vancouver, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/269,713

(22) Filed: Nov. 12, 2008

(65) Prior Publication Data

US 2009/0068398 A1 Mar. 12, 2009

Related U.S. Application Data

(63) Continuation of application No. 11/202,673, filed on Aug. 12, 2005, now Pat. No. 7,461,808, which is a continuation-in-part of application No. 11/187,343, filed on Jul. 21, 2005.

(51) Int. Cl.
*B65H 19/18* (2006.01)

(52) U.S. Cl. ..... 242/555.4; 242/556

(58) Field of Classification Search ..... 242/551, 242/553, 555, 555.3, 555.4, 556; 24/38, 24/31 L, 31 F, 23 B, 21, 182, 196, 701, 593.1, 24/580.11, 464, 298, 302, 265 EC; 156/157, 156/502; 493/381; 226/92

See application file for complete search history.

(56) References Cited

U.S. PATENT DOCUMENTS

| | | | | |
|---|---|---|---|---|
| 4,917,327 | A | 4/1990 | Asbury et al. | |
| 5,029,768 | A | 7/1991 | Asbury et al. | |
| 5,775,629 | A | 7/1998 | Cyr | |
| 5,784,762 | A * | 7/1998 | Huntting | 24/129 R |
| 6,325,324 | B1 | 12/2001 | Getz et al. | |
| 6,596,111 | B2 | 7/2003 | Cyr et al. | |
| 6,622,959 | B2 | 9/2003 | Robitaille | |
| 6,688,363 | B2 | 2/2004 | Cyr et al. | |

(Continued)

FOREIGN PATENT DOCUMENTS

CA 2188325 4/1998

OTHER PUBLICATIONS

Forbo Adhesives sales literature, "Alternative Splicing Method (ASM)" 2 pages (publication date unknown).

(Continued)

*Primary Examiner* — William E Dondero
(74) *Attorney, Agent, or Firm* — Klarquist Sparkman, LLP

(57) ABSTRACT

An apparatus and method for splicing tapes dispensed from a tape dispenser. According to one embodiment, a first, running or unwinding roll of tape is provided with a first splicing element secured to its trailing end portion. A second, stationary or standby roll of tape is provided with a second splicing element secured to its leading end portion. The second splicing element comprises a body made of a self-supporting material and formed with at least one aperture sized to receive the tape from the first roll. While tape is being dispensed from the first roll, the running tape is inserted into the aperture of the second splicing element. When the first roll of tape becomes depleted, the first splicing element engages the second splicing element, thereby splicing the leading end portion of the second tape roll to the trailing end portion of the first tape roll.

25 Claims, 7 Drawing Sheets

U.S. PATENT DOCUMENTS 6,737,138 B2 5/2004 Cyr et al.
6,981,537 B2 1/2006 Cyr et al.

OTHER PUBLICATIONS

Forbo Adhesives sales literature, "PSA Splicing" 2 pages (publication date unknown).

Forbo Ahesive sales literature, "NTT™ Splicing" 4 pages (publication date unknown).

Forbo Adhesives sales literature, "Connector Ring Splicing (CRS)" 2 pages (publication date unknown).

Internet website, Alibaba.com, "SDW Dongguan Shandai Garment Accessories Co. Ltd.—Printed Shoulder Tape," http://sdw.en.alibaba.com/product/50130759/50601163/Shoulder_Straps/Printed_Shoulder_Tape.html (2 pages).

Internet website, Alibaba.com, "SDW Dongguan Shandai Garment Accessories Co. Ltd.—Bra Adjuster," http://sdw.en.alibaba.com/product/50130756/50601178/Bra_Adjusters/Bra_Adjuster_9_Shaped.html (1 page).

International Search Report and Written opinion of the International Searching Authority, mailed Jan. 9, 2007, for corresponding International Application No. PCT/US2006/028469.

Statement Regarding Prior Splicing Device by Scott K. Middelstadt, Jan. 30, 2007, 4 pages.

Statement by Sharon Nelson, dated Nov. 19, 2007, 5 pages.

Office action from the United States Patent & Trademark Office in U.S. Appl. No. 11/187,343, dated Jun. 18, 2007.

Office action from the United States Patent & Trademark Office in U.S. Appl. No. 11/187,343, dated Jul. 18, 2007.

Final Office action from the United States Patent & Trademark Office in U.S. Appl. No. 11/187,343, dated Feb. 21, 2008.

Office action from the United States Patent & Trademark Office in U.S. Appl. No. 11/202,673, dated Jul. 18, 2007.

Office action from the United States Patent & Trademark Office in U.S. Appl. No. 11/202,673, dated Feb. 5, 2008.

Notice of Allowance from the United States Patent & Trademark Office in U.S. Appl. No. 11/202,673, dated Aug. 13, 2008.

Supplementary European Search Report from the European Patent Office for European Application No. EP06800223.7-1256, Feb. 19, 2010, 8 pages.

* cited by examiner

SPLICING APPARATUS AND METHOD

CROSS-REFERENCE TO RELATED APPLICATIONS

This application is a continuation of U.S. application Ser. No. 11/202,673, filed Aug. 12, 2005, now U.S. Pat. No. 7,461,808, which is a continuation-in-part of U.S. application Ser. No. 11/187,343, filed Jul. 21, 2005, both of which applications are incorporated herein by reference.

FIELD

The present disclosure concerns an apparatus and method for automatically splicing an unwinding roll of material to a stationary roll of material, such as tape.

BACKGROUND

Modern consumer and industrial packaging often includes reinforcing tapes or tear tapes as part of their construction. Various tape dispensers have been designed to dispense such tapes into corrugator and packaging equipment. Known tape dispensers include a first spindle that supports an unwinding spool of tape and a second spindle that supports a stationary, or standby, spool of tape. To provide a continuous feed of tape, splicing techniques have been developed for automatically splicing together the trailing end of the unwinding spool of tape to the leading end of the standby spool of tape.

One example of a tape dispenser and splicing technique is disclosed in U.S. Pat. No. 4,917,327 to Asbury, Jr. et al. In the splicing technique disclosed in the '327 patent, the trailing end of a first spool of tape is provided with a pin and the leading end of a second spool of tape is provided with a piece of string or cord. As the first spool of tape is being dispensed, an operator forms a loop around the tape of the first spool with the string by placing the string around the tape and tying the ends of the string together. When the first spool is depleted, the pin engages the loop to link the tape of the first spool to the tape of the second spool, causing the tape of the first spool to cause the second spool to begin rotating and pull the tape from the second spool into the packaging equipment.

A continuing need exists for improved techniques for splicing one spool of tape to another spool of tape.

SUMMARY

The present disclosure concerns embodiments of an apparatus and method for splicing tapes dispensed from a tape dispensing machine where a continuous supply of tape is required. According to one embodiment, a first, running or unwinding roll of tape is provided with a first splicing element secured to its trailing end portion. A second, stationary or standby roll of tape is provided with a second splicing element secured to its leading end portion. The second splicing element comprises a body made of a self-supporting material and formed with at least one aperture sized to receive the tape from the first roll.

When the rolls are installed on a tape dispenser and the first roll is running, an operator brings the second splicing element, which is secured to the leading end portion of the second, standby tape roll, in close proximity to the running tape and inserts the running tape into the aperture in the second splicing element. The aperture is sized to allow the running tape, but not the first splicing element, to freely pass through the aperture. Thus, when the first roll of tape becomes depleted, the first splicing element engages the second splicing element, thereby splicing the leading end portion of the second tape roll to the trailing end portion of the first tape roll.

The spicing system disclosed in the present application provides several advantages over the "pin and loop" splicing system disclosed in the '327 patent. For example, less operator involvement and dexterity is required because the second splicing element can be easily placed around the running tape without the need to tie a knot with a string. In addition, in the prior system, the splice can depend on the quality of the knot and/or the size of the loop formed around the running tape. If the knot is too loose or if the loop is too large, the pin can pass through the tied string, resulting in the failure of the splice. If the knot is too tight or if the loop is too small, the running tape may contact the edges of the running tape and the friction can cut the string, resulting in the failure of the splice. In addition, a loop that is made too small can cause the running tape to prematurely pull the standby tape before the first tape roll is depleted, resulting in the first and second tapes being dispensed together into the packaging equipment. The splicing system disclosed herein does not suffer from such limitations and can be used to achieve splices at dispensing rates not previously possible with the pin and loop system. In certain embodiments, for example, the splicing elements disclosed herein can be used to form splices at dispensing rates of at least about 1100 feet per minute, and more desirably about 1400 feet per minute and greater.

In some package-forming applications, it may be desirable to provide for consistent spacing between the spliced ends of tapes from one splice to the next. For example, in one such application, multiple radio frequency identification (RFID) devices, used for managing and tracking packages, are attached to reinforcing tape at equally spaced locations on a package, as further described in co-pending U.S. application Ser. No. 11/122,977, filed May 4, 2005, which is incorporated herein by reference. Providing constant spacing (or no spacing) between the spliced ends of tapes facilitates the proper placement of the RFID devices on the tapes. Unfortunately, in the prior pin and loop splicing system, the spacing between the adjacent ends of the spliced tapes can vary depending on the size of the loop that is formed. However, in the splicing system disclosed herein, the second splicing element has an aperture of a predetermined size and therefore can achieve consistent spacing between the spliced ends of tapes in successive splices.

In particular embodiments, the second splicing element includes a slit extending from the aperture to an outer peripheral edge of the body and a flexible peripheral portion at least partially bounding the aperture. To insert the running tape into the aperture, an operator bends the peripheral portion to create a gap between the opposing edges of the slit and inserts the running tape into the aperture via the gap.

In another embodiment, the second splicing element is formed with a permanent opening or gap extending from the aperture to an outer peripheral edge of the body. The gap is of sufficient width to allow an operator to insert the running tape through the gap and into the aperture without bending or flexing of the peripheral portion of the body surrounding the aperture.

The second splicing element can be secured to the standby tape roll by inserting the leading end portion of the tape through the aperture and folding back and securing the tape to itself so as to form a loop extending through the aperture. Alternatively, the second splicing element can be formed with two separate apertures, one of which is used to secure the leading end portion of the standby tape roll and the other of which receives the running tape.

In another embodiment, the second splicing element includes a first body portion and a second body portion foldably coupled to each other along a folding axis, allowing the first and second body portions to be folded closed and opened relative to each other. The first body portion includes a first aperture for receiving the running tape, a slit extending from the first aperture to an outer peripheral edge of the first body portion, and a flexible tab portion at least partially bounding the first aperture. The second body portion includes a second aperture for receiving the running tape, a slit extending from the first aperture to an outer peripheral edge of the first body portion, and a flexible tab portion at least partially bounding the first aperture. In use, an operator first places the first body portion around the running tape by bending the respective tab portion to create a gap and inserting the running tape into the first aperture via the gap. The operator then places second body portion around the running tape in a similar manner and folds the body portions against each other. A suitable adhesive, such as a layer of double-sided tape or a liquid adhesive, can be provided to adhesively secure the body portions together in the closed position.

In still another embodiment, the first and second body portions are pivotally coupled to each other by a pivot pin extending through the body portions, rather than being foldably coupled to each other. The body portions can be pivoted relative to each other in mutually parallel planes between a closed and open position.

In yet another embodiment, the second splicing element comprises a wire-like, elongated piece of material formed so as to have a closed geometric shape having overlapping end portions. The splicing element can be placed around the running tape by moving the leg portions away from each other and inserting the running tape through the opening between the leg portions.

The foregoing and other objects, features, and advantages of the invention will become more apparent from the following detailed description, which proceeds with reference to the accompanying figures.

DETAILED DESCRIPTION

As used herein, the singular forms "a," "an," and "the" refer to one or more than one, unless the context clearly dictates otherwise.

As used herein, the term "includes" means "comprises."

The present disclosure concerns embodiments of a splicing technique, such as can be used to splice the trailing end of an unwinding roll of tape being dispensed to the leading end of a stationary or standby roll of tape. The splicing technique can be implemented in any tape dispenser operable to dispense tape from a first, running spool of tape and then a second, standby spool of tape.

Figure 1A:
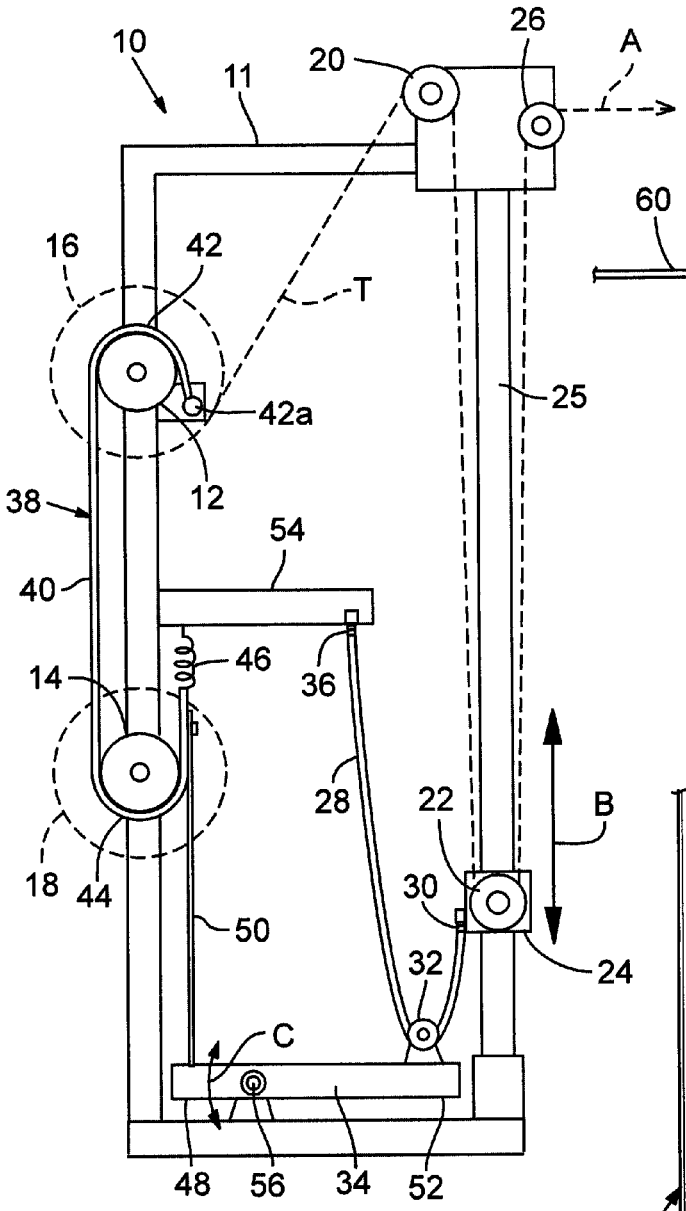
FIG. 1A is a schematic illustration of a tape dispenser that is operable to dispense tape from a first, running spool of tape, and then from a second, standby spool of tape.

FIG. 1A, for example, shows a schematic illustration of a dispensing apparatus, indicated generally at 10, for dispensing tape from a first roll, or spool of tape 16 and a second roll, or spool of tape 18. Apparatus 10 includes a frame 11. Mounted on the frame 11 for rotational movement are a first spindle 12 and a second spindle 14. The first spindle 12 supports the first spool of tape 16 and the second spindle 14 supports the second spool of tape 18. Tape T from one of the first and second spools 16, 18 is routed over a fixed roller 20, down to a tensioning roller 22 of a tension-control mechanism 24, and over a fixed roller 26, and then is fed to downstream equipment (e.g., corrugator or other packaging equipment used for producing, for example, folding cartons), as indicated by arrow A. Apparatus 10 also can be used to dispense tape into other types of tape-consuming devices, such as applicators used to apply tape to wood substrates (e.g., plywood).

The tension-control mechanism 24 is movable in two directions (upwardly and downwardly, as indicated by double-headed arrow B, in the illustrated embodiment) along an upright rail 25 to vary the path length of the tape in response to changes in tension in the tape. The tension-control mechanism 24 is pulled downwardly by an elongated biasing member 28 (which can be a piece of elastic material, such as surgical tubing) and upwardly by the tension in the tape. Thus, when tape tension is high (i.e., when the current spool is providing tape slower than is required by downstream equipment, such as at the beginning of a spool), the tension-control mechanism moves upwardly. The upward movement of the tension-control mechanism 24 shortens the tape path so that tape can be fed to downstream equipment without requiring the spool to dispense a corresponding length contemporaneously. Conversely, when tape tension is low (i.e., when the current spool is providing tape faster than is required by downstream equipment), the biasing member 28 causes the tension-control mechanism 24 to assume a lower position (as shown in FIG. 1) to increase the length of the tape path.

The biasing member 28 is reeved around a pulley 32 of a pivoted lever 34, and has a first end 30 connected to the tension-control member 24 and a second end 36 secured to an extension 54 of frame 11. Lever 34 is mounted for pivoting movement about a pivot pin 56, as indicated by double-headed arrow C.

A brake assembly 38 applies a controlled braking force to the first and second spindles 12, 14, respectively. The brake assembly 38 includes a brake band 40 that extends about portions of spindles 12, 14 and serves to retard their rotation. An upper end portion 42 of the band 40 is affixed to frame, as at 42*a*, and therefore is stationary. A lower end portion 44 of the band 40 is coupled to extension 54 of frame 11 by a coil spring 46. Spring 46 pulls upwardly on the lower end portion 44 of band 40, causing the band to automatically apply a quiescent braking force to the spindles 12, 14. As used herein, the term "quiescent braking force" refers to a braking force applied to a spindle when the spindle is at rest. Other brake assembly configurations can be implemented in the dispensing apparatus.

As shown in FIG. 1A, the lower end portion 44 of band 40 is coupled to a first end portion 48 of the lever 34 by a connecting member 50. The brake assembly 38, lever 34, tension-control mechanism 24, and biasing member 28 cooperate to form a feedback mechanism, by which the brake assembly 38 applies a controlled braking force in response to changes in the tension in the tape. More specifically, when tape tension is high, the tension-control mechanism 24 travels upwardly, which in turn causes a second end portion 52 of the lever 34 to move upwardly and the first end portion 48 of the lever 34 to move downwardly. This movement is coupled to the brake assembly 38 by connecting member 50, which pulls against the spring 46, thereby reducing tension in the brake band 40 and causing a decrease in braking force so that the dispensing of tape can be accelerated. Conversely, when tape tension is lowered, the tension-control mechanism 24 travels downwardly under the biasing force of biasing member 28, which in turn allows the first end 48 of the lever 34 to move upwardly. This motion permits the spring 46 to reapply more tensioning force to the brake band 40, thereby causing a corresponding increase in the braking force to reduce the rate at which tape is being dispensed.

When the first spool 16 becomes depleted of tape, splicing the trailing end of the tape from the first spool 16 to the leading end of the tape from the second spool 18 will automatically bring the second spool 18 into action. The feedback mechanism serves to control the braking force in response to tension spikes that can occur during and immediately following splicing. For example, since the second spool 18 cannot immediately supply tape at the rate required by downstream equipment (due to the inertia of the second spool 18), the tension in the tape suddenly increases. The increased tension causes the tension-control mechanism 24 to move upwardly, which in turn causes the brake assembly 38 to reduce the braking force to allow rotation of the second spool 18. Also, the upward movement of the tension-control mechanism 24 shortens the tape path, thereby providing tape to the downstream equipment without requiring the second spool 18 to dispense a corresponding length contemporaneously.

As the second spool 18 accelerates to the required speed, the tension in the tape decreases, thereby allowing the tension-control mechanism 24 to be pulled downwardly by the biasing member 28. This movement activates the brake band 40, which applies a gradually increasing braking force on the second spindle 14 in response to the decrease in tape tension until equilibrium is established.

As a spool is dispensing tape, the diameter of the tape on the spool decreases. The feedback mechanism provided by the brake assembly 38, lever 34, tension-control mechanism 24, and biasing mechanism 28 compensates for the diametrical change of the spool by gradually decreasing the braking force to ensure substantially uniform tension throughout an entire roll. Without such a feedback system, the tension in the tape would increase in proportion to the change in radius of the spool from which the tape is dispensed.

If, following a splicing operation, the second spool 18 accelerates beyond the rate at which tape is being pulled by the downstream equipment, slack can form in the second spool 18. The slack can become stuck to the spool, entangled with the tape path, and/or cause tape breakage, which then requires a stoppage in production to fix the problem. This phenomenon is known as "overrun." Thus, to prevent such overrun of the second spool following a splice, the brake band must provide a braking torque sufficient to prevent the second spool 18 from accelerating beyond the rate at which tape is being pulled by the downstream equipment. It can be appreciated that increasing the rate at which tape is dispensed requires a corresponding increase in available braking torque to prevent over-acceleration of a spool following a splicing operation.

However, if the braking torque on a spindle is too high, the upward pulling force of the tension-control mechanism 24 (caused by an increase in tension) may not be sufficient to overcome the spring 46 to permit the spindle to accelerate to the required speed. Hence, the braking torque desirably should be great enough to prevent over-acceleration at a desired dispensing rate without adversely affecting the ability of the system to overcome the biasing mechanism (e.g., spring 46) that retards rotation of the spindles.

In FIG. 1A, apparatus 10 is shown dispensing tape from the first spool 16. When the tape from the first spool 16 is depleted, the trailing end portion of the tape from the first spool 16 can be spliced to the leading end portion of the tape from the second spool 18 to provide a continuous feed of tape. While tape is being dispensed from the second spool 18, another full spool of tape can be loaded onto the first spindle 12. The leading end portion of the tape from the new spool can then be spliced to the trailing end portion of tape from the second spool 18. This process can be repeated as necessary with any number of spools.

Figure 1B:
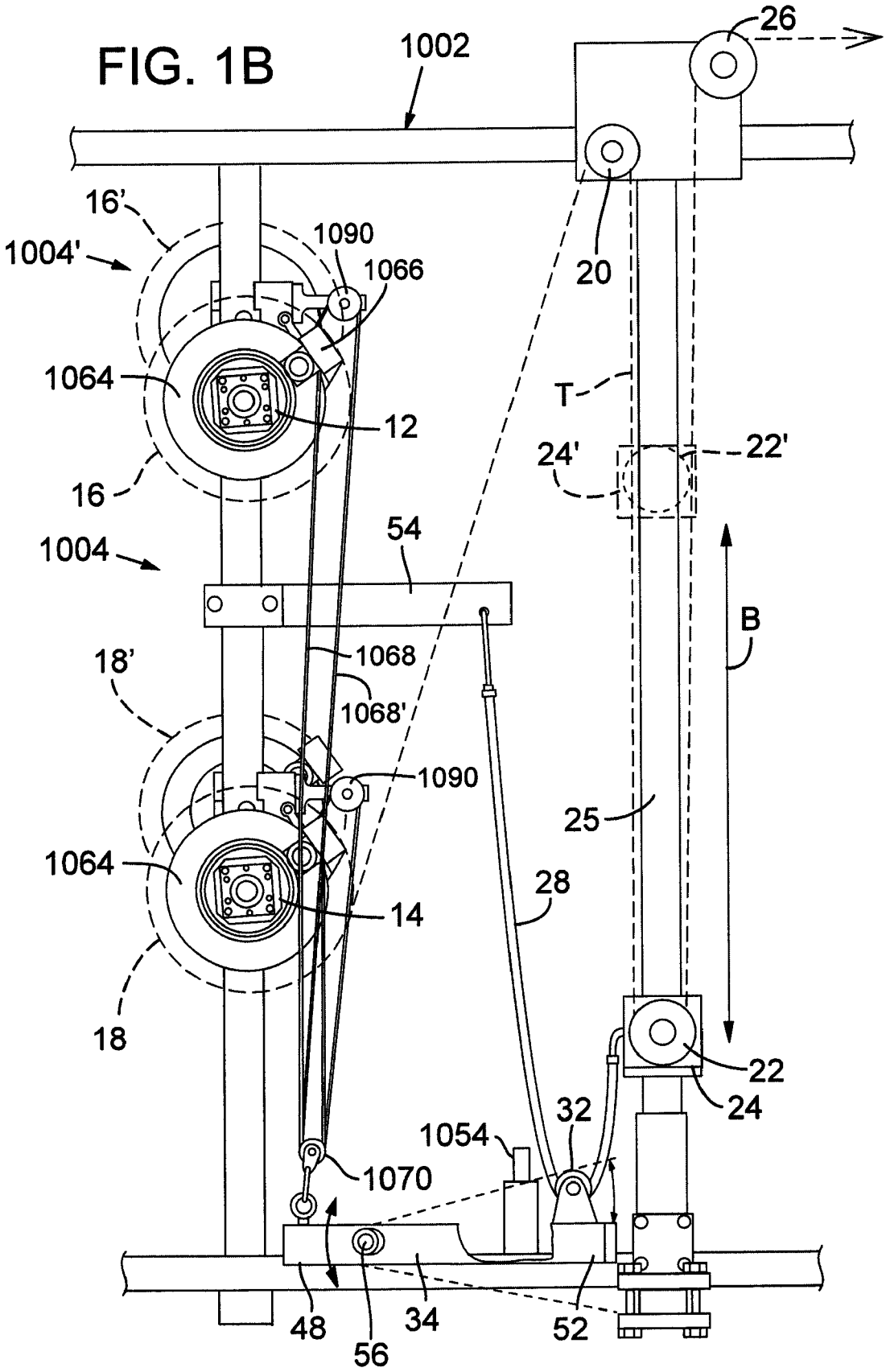
FIG. 1B is a schematic illustration of a tape dispenser, according to another embodiment.

FIG. 1B shows an alternative embodiment of a dispensing apparatus that can be used to dispense tape. This embodiment shares many similarities with the embodiment of FIG. 1A. Hence, components in FIG. 1B that are identical to corresponding components in FIG. 1A have the same respective reference numerals and are not described further. Also, to provide a more detailed disclosure without unduly lengthening the specification, applicants incorporate herein by reference the disclosures of co-pending U.S. application Ser. Nos. 10/359,521, filed Feb. 5, 2003 and 10/463,481, filed Jun. 16, 2003.

The apparatus shown in FIG. 1B includes a frame 1002 on which there are multiple dispensers 1004 mounted on one side of the frame 1002 (one of which is shown in FIG. 1B) and multiple dispensers 1004' mounted on the opposite side of the frame 1002 (one of which is shown in FIG. 1B). Components of dispensers 1004' that are identical to corresponding components of dispensers 1004 are given the same respective reference numerals, except that the reference numerals for the components of dispensers 1004' are followed by an apostrophe (').

Instead of the brake band 40 (FIG. 1A), each spindle 12, 14 in the embodiment of FIG. 1B is provided with a brake assembly comprising a rotor 1064 mounted to the inboard end of each spindle and a caliper 1066 mounted at a fixed position relative to a respective rotor 1064. Each caliper 1066 is operable to provide a braking force to a respective rotor 1064, such as by clamping or squeezing the rotor between two surfaces of the caliper, as known in the art.

The dispenser 1004 includes an elongated tension member 1068, which is reeved around a pulley 1070 connected to end portion 48 of a lever 34 and is coupled at its opposite end portions to calipers 1066 of the first and second spindles 12, 14. Tension member 1068 can be, for example, a conventional brake cable, such as used in a brake assembly of a bicycle. The calipers 1066 are normally biased to exert a quiescent braking force to rotors 1064. Movement of tension member 1068 causes the calipers 1066 to reduce the braking force applied to the rotors.

The dispenser 1004' similarly includes a tension member 1068' connected at opposite ends to corresponding calipers of the upper and lower spindles of the dispenser 1004'. In the illustrated embodiment, the brake assemblies of the dispenser 1004' are mounted in an "upside down" position to permit mounting in close proximity to the brake assemblies of the dispenser 1004. Because of this mounting arrangement, the end portions of the tension member 1068' are reeved around pulleys 1090 before being routed down to a pulley mounted on a respective lever (not shown) at the base of the dispenser 1004'.

The dispenser 1004 can also include a stop 1054 which limits upward pivoting of end portion 52 of the lever 34 to protect the brake assembly from excessive forces when there is an increase in tape tension.

Figure 2:
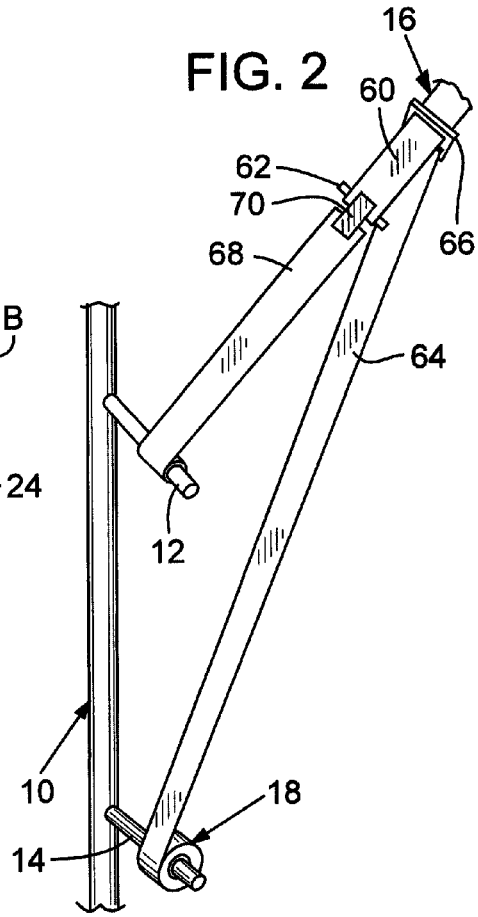
FIG. 2 is an illustration showing a splicing technique for automatically splicing the trailing end portion of a first, running tape to the leading end portion of a second tape of a stationary spool.

Referring now to FIG. 2, a method for automatically splicing the tape from the second spool 18 to the tape from first spool 16 will now be described. As used herein, the phrase "automatic splicing" or "automatically splicing" refers to splicing operations in which the trailing end portion of a first spool is caused to splice to the leading end portion of a second spool while substantially maintaining the rate at which tape is supplied to downstream equipment.

The tape from the first spool (also referred to as the "first tape") 16 has at its trailing end portion 60 a first splicing element 62. The tape from the second spool (also referred to as the "second tape") 18 is provided at its leading end portion 64 with a second splicing element 66. When the first splicing element 62 engages the second splicing element 66, the tapes become linked, causing the trailing end portion 60 of the first tape 16 to pull the leading end portion 64 of the second tape 18 into the downstream equipment.

Typically, the first tape spool 16 is provided with respective first and second splicing elements 62, 66 on its trailing and leading end portions, respectively, and the second tape spool 18 is provided with respective first and second splicing elements 62, 66 on its trailing and leading end portions, respectively. In this way, any number of tape spools can be successively spliced together to provide a continuous feed of tape.

The first and second tapes can be any of various tapes known in the art (e.g., adhesive tapes, such as hot melt tapes, used in packaging). For example, the tapes can be those sold under the Sesame brand by Adalis Corporation, an H. B. Fuller Company, of Vancouver, Wash.

When the trailing end portion 60 of the first tape 16 comes off spindle 12 (or the core of the tape roll supported on the spindle 12), it would normally be free to twist or turn. In certain applications, such movement, however, may result in the tape being introduced into the downstream equipment wrong side down. The second tape 18 would likewise be misoriented. To avoid this problem, the trailing end portion 60 of the first tape 16 desirably is provided with a tail segment 68 affixed to the core (not shown) of the tape roll. The tail segment 68 has a length sufficient so that the second tape 18 becomes linked to the first tape 16, in the proper orientation, before the end of the tail segment is reached. In other applications, the tail segment 68 may not be needed or required.

In the illustrated embodiment, the tail segment 68 is detachably connected to the tailing end portion 60 of the first tape 16 with, for example, a piece of tape 70 (e.g., masking tape). The other end of the tail segment 68 is securely affixed to the core of the tape roll. When the first tape 16 draws the tail segment 68 tight, the masking tape 70 is pulled free from the trailing end portion 60, leaving the tail segment 68 dangling from the core and leaving the first and second tapes 16, 18 free to travel into the downstream equipment.

In other embodiments, the tail segment 68 need not be detachable as shown. Instead, it can be securely affixed to the trailing end portion 60 and not secured to the core. Thus, when the end of the tail segment comes free of the core, it is introduced into the downstream equipment and applied with the first and second tapes 16, 18.

Figure 3:
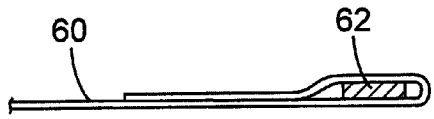
FIG. 3 is an illustration showing the splicing element affixed to the trailing end portion of the running tape shown in FIG. 2.

The first splicing element 62 can be attached to the trailing end portion 60 of the first tape in a variety of ways. FIG. 3 shows a technique applicable to adhesive tapes, such as hot melt tapes. In this technique, the first splicing element 62 is placed on the tape and the tape is folded back and adhered to itself so as to secure the splicing element between the two adjacent pieces of tape.

The first splicing element 62 in the illustrated configuration has a generally flat, rectangular cross-sectional profile. In other embodiments, however, the first splicing element 62 can have other shapes. For example, the first splicing element 62 can be elongated rod or pin shaped member. The first splicing element 62 has a length that is greater than the opening in the second splicing element 66 to prevent the first splicing element 62 from passing through the opening, as further described below.

Figure 5:
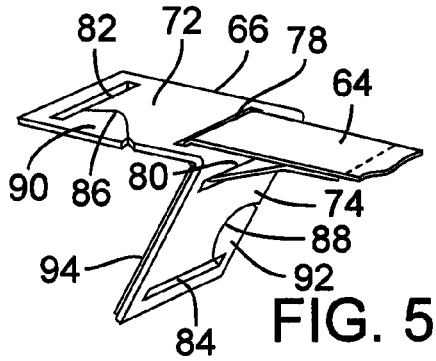
FIG. 5 is a perspective view of the splicing element of FIG. 4 shown after being secured to the leading end portion of the standby tape.
Figure 6:
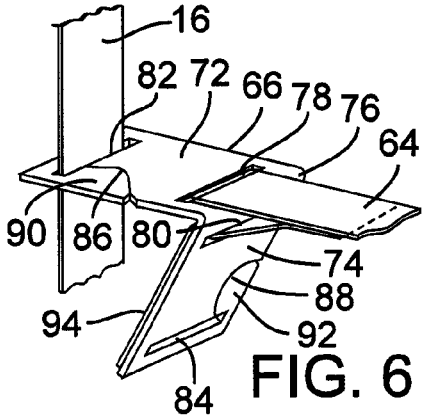
FIG. 6 is a perspective view of the splicing element of FIG. 4 shown after the running tape is introduced into an aperture in a first body portion of the splicing element.
Figure 7:
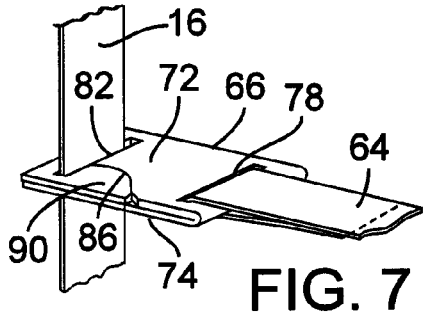
FIG. 7 is a perspective view of the splicing element of FIG. 4 shown after the running tape is introduced into an aperture in a second body portion and the first and second body portions are folded closed.

FIGS. 4-7 illustrate the second splicing element 66 in greater detail. As shown, the second splicing element 66 comprises a body including a first flap or body portion 72 foldably coupled to a second flap or body portion 74 by a hinged portion 76. The body portions 72, 74 therefore can be folded together to a closed position when placed around the running first tape 16, as depicted in FIG. 7. In the illustrated embodiment, the splicing element 66 is made of a flexible, unitary piece of material that can be folded widthwise in half at the hinged portion 76. A score line (not shown) can be formed at the center of the splicing element along the length of the hinged portion 76 to facilitate folding the body portions. The splicing element 66 can have a substantially uniform thickness along its length as shown. Alternatively, the hinged portion 76 can be formed from a center portion of reduced thickness extending widthwise of the splicing element. In other embodiments, each of the flap portions 72, 74 and the hinged portion 76 can be separately formed and subsequently joined to each other using suitable techniques or mechanisms (e.g., fasteners or adhesives).

The splicing element 66 is made of a flexible, self-supporting material, which exhibits sufficient strength and rigidity to maintain a splice at the desired dispensing speed. As used herein the term "self-supporting" refers to a material that can retain its shape under its own weight. If the dispensing apparatus is dispensing tape into a corrugator (a device for making corrugated cardboard blanks) or similar devices, the first and second splicing elements 62, 66 preferably are made of a material that can be applied to the cardboard blanks by the corrugator. Examples of suitable materials for splicing elements 62, 66 include plastic, cardboard, paperboard, wood, composites, resin impregnated fiber (e.g., carbon or glass fiber), metal, metal alloys, or combinations thereof.

The first and second body portions 72, 74 are formed with respective first elongated slots, or openings, 78, 80 dimensioned to receive the leading end portion 64 of the second tape 18. The slots 78, 80 are positioned such that they become aligned with each other when the body portions 72, 74 are folded closed. The leading end portion 64 of the second tape 18 can be secured to the second splicing element 66 by inserting the tape through the slots 78, 80 and folding back and adhering the tape to itself as shown in FIGS. 5-7. If non-adhesive tape is used, then the tape can be inserted through the slots 78, 80 and secured to itself using a suitable fastener.

The first and second body portions 72, 74 also are formed with respective second elongated slots, or openings, 82, 84 spaced from their respective first slots 78, 80. The second slots 82, 84 are dimensioned to receive the first tape 16 and are positioned such that they become aligned with each other when the body portions 72, 74 are folded closed. The first body portion 72 is formed with a slit 86 extending from an inner peripheral edge bounding the slot 82 to an outer peripheral edge of the first body portion 72. A tab portion 90 partially bounds the slot 82 and forms a bendable portion that can be bent or folded away from the first body portion to create a gap or opening between the opposing edges of the slit 86. The second body portion 74 likewise is formed with a slit 88 extending from an inner peripheral edge bounding the slot 84 to an outer peripheral edge of the second body portion 74. A tab portion 92 partially bounds the slot 84 and forms a bendable portion that can be bent or folded away from the second body portion to create a gap or opening between the opposing edges of the slit 88.

With the second splicing element 66 secured to the leading end portion 64 of the second tape 18 (FIG. 5), the first body portion 72 is placed on the first tape 16 by bending tab portion 90 so as to create a gap between the opposing edges of the slit 86 and inserting the tape 16 into the slot 82 via the gap (FIG. 6). Similarly, the second body portion 74 is placed on the first tape 16 by bending tab portion 92 so as to create a gap between the opposing edges of the slit 88 and inserting the tape 16 into the slot 84 via the gap (FIG. 7). The inner surface of the second body portion 74 (and/or the inner surface of the first body portion 72) can be provided with a piece of double-sided tape 94 (or another suitable adhesive) (shown in FIGS. 4-6). Thus, when both the first and second body portions 72, 74 are placed around the first tape 16, the body portions are pressed and held together in the closed position (FIG. 7) by the tape 94.

In lieu of or in addition to the tape 94, other techniques or mechanisms can be used to retain the body portions 72, 74 in the closed position. For example, the first body portion 72 can have a locking member or locking surface that forms a "snap fit" connection with a mating surface on the second body portion 74.

Figure 4:
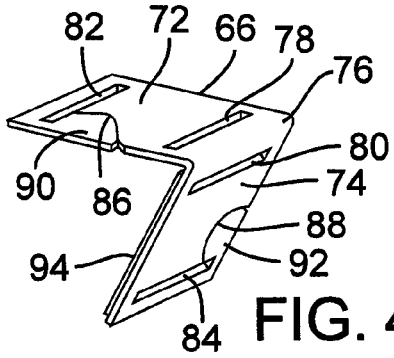
FIG. 4 is a perspective view of the splicing element that is secured to the leading end portion of the second, standby tape shown in FIG. 2.

In the illustrated embodiment, the opposing edges of the slits 86, 88 contact each other when the tab portions 90, 92 are in their normal, non-bent or closed positions shown in FIG. 4. In other embodiments, however, the first and second body portions can be formed with permanent gaps or openings between the opposing edges of the slits 86, 88 (i.e., the opposing edges of the slits do not contact each other). The gaps can be of sufficient width so as to permit the first tape 16 to be inserted into the slots 82, 84 via the permanent gaps without bending the tab portions 90, 92.

In certain embodiments, the splicing element 66 can be made from a flexible, resilient material that has shape memory, such as plastic, such that the tab portions 90, 92 return to their original, closed positions after the body portions 72, 74 are placed around the running tape 16. In alternative embodiments, the splicing element 66 can be made form a material that has little or no shape memory. In such embodiments, after the splicing element 66 is placed around the running tape 16, the tab portions 90, 92 are bent back to their original positions by an operator.

The slots 82, 84 are dimensioned to permit the first tape 16 to freely pass through the second splicing element 66 while the first tape is being dispensed. The first splicing element 62 (FIGS. 2 and 3) has a length greater than that of the slots 82, 84. Thus, when the first spool of tape 16 becomes depleted, the first splicing element 62 cannot pass through the slots 82, 84, and therefore engages the second splicing element 66, forming a splice between the trailing end portion 60 of the first tape 16 and the leading end portion 64 of the second tape 18.

When the first splicing element 62 engages the second splicing element 66, the first splicing element exerts a pulling force on the second splicing element. As shown, the slits 86 and 88 desirably are formed on opposite sides of the splicing element 66. This configuration better resists against flexure or deformation of the tab portions 90, 92 caused by the pulling force of the first splicing element 62 to retain the first tape 16 within the slots 82, 84 and maintain the splice. The adhesive tape 94, by adhesively securing the tab portions 90, 92 against opposing surfaces of body portions 74, 72, respectively (FIG. 7), further resists against flexure of the tab portions to maintain the splice.

In particular embodiments, the splicing element 66 is made of plastic and has an overall thickness (when the body portions 72, 74 are folded closed) in the range of about 10 to 125 thousandths of an inch (about 0.01 to 0.125 inch), and more desirably in the range of about 50 to 100 thousandths of an inch (about 0.05 to 0.10 inch). Of course, these specific dimensions (as well as other dimensions provided in the present specification) are given to illustrate the invention and not to limit it. The dimensions provided herein can be modified as needed in different applications or situations.

Figure 8:
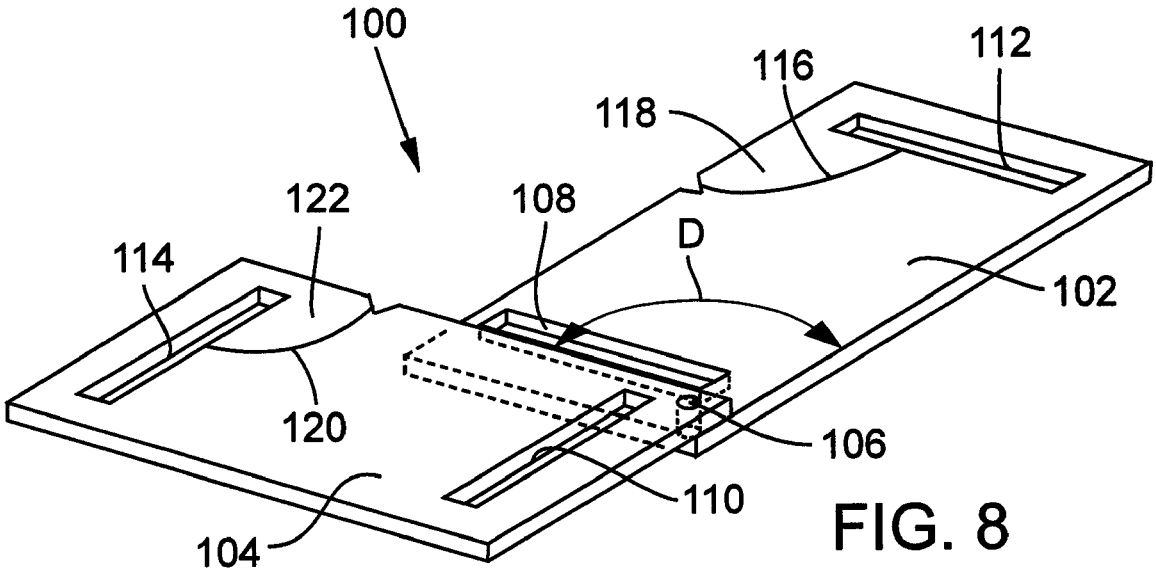
FIG. 8 is a perspective view of a splicing element, according to another embodiment, adapted to be secured to the leading end portion of a standby tape, shown in an open position.
Figure 9:
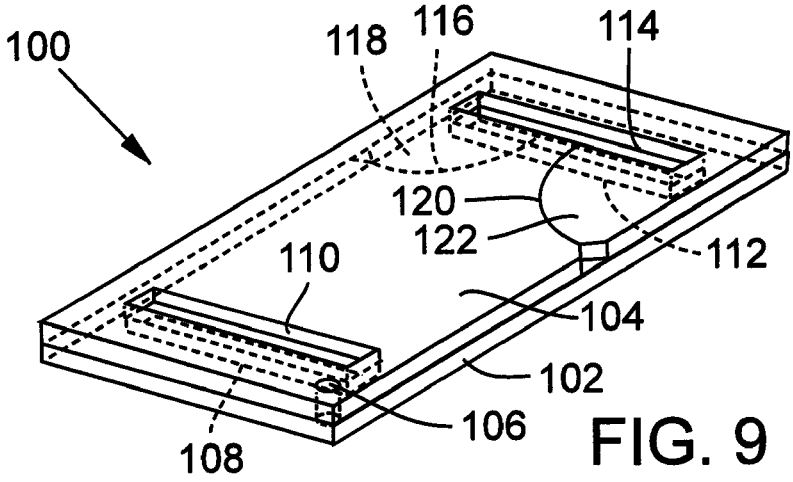
FIG. 9 is a perspective view of the splicing element of FIG. 8 shown in a closed position.

FIGS. 8 and 9 show a splicing element 100, according to another embodiment, that can be used in lieu of splicing element 66 (FIGS. 4-7). The splicing element 100 includes a first body portion 102 and a second body portion 104 pivotally coupled to each other by a pivot pin 106 extending through the body portions. The body portions 102, 104 can be pivoted relative to each other, in the directions indicated by double-headed arrow D, in mutually parallel planes between an open position (FIG. 8) and a closed position (FIG. 9) in which the body portions overlap each other.

The first and second body portions 102, 104 are formed with respective first elongated slots, or openings, 108, 110 dimensioned to receive the leading end portion of a standby tape (e.g., tape 18 in FIG. 2). The first and second body portions 102, 104 also are formed with respective second elongated slots, or openings, 112, 114 spaced from their respective first slots 108, 110. The second slots 112, 114 are dimensioned to receive a running tape (e.g., tape 16 in FIG. 2). The first body portion 102 is formed with a slit 116 extending from an inner peripheral edge bounding the slot 112 to an outer peripheral edge of the first body portion 102. A tab portion 118 partially bounds the slot 112 and forms a bendable portion that can be bent or folded away from the first body portion to create a gap or opening between the opposing edges of the slit 116. The second body portion 104 likewise is formed with a slit 120 extending from an inner peripheral edge bounding the slot 114 to an outer peripheral edge of the second body portion 104. A tab portion 122 partially bounds the slot 114 and forms a bendable portion that can be bent or folded away from the second body portion to create a gap or opening between the opposing edges of the slit 120. When the body portions 102, 104 are pivoted closed (FIG. 9), the first slot 108 of the first body portion 102 aligns with the first slot 110 of the second body portion 104, and the second slot 112 of the first body portion 102 aligns with the second slot 114 of the second body portion 104.

The splicing element 100 is used in a manner similar to that described above in connection with the splicing element 66. For example, the leading end portion of a standby tape is secured to the splicing element 100, such as by pivoting the body portions 102, 104 closed (FIG. 9) and forming a loop through the slots 108, 110 with the tape. The splicing element 100 is then placed on a running tape, for example, by bending tab portion 118 to create a gap, inserting the running tape into the slot 112 via the gap, bending tab portion 122 to create a gap, and inserting the running tape into the slot 114 via the gap. When the splicing element on the trailing end portion of the running tape (e.g., splicing element 62) engages splicing element 100, the standby tape becomes spliced to the running tape.

Figure 10:
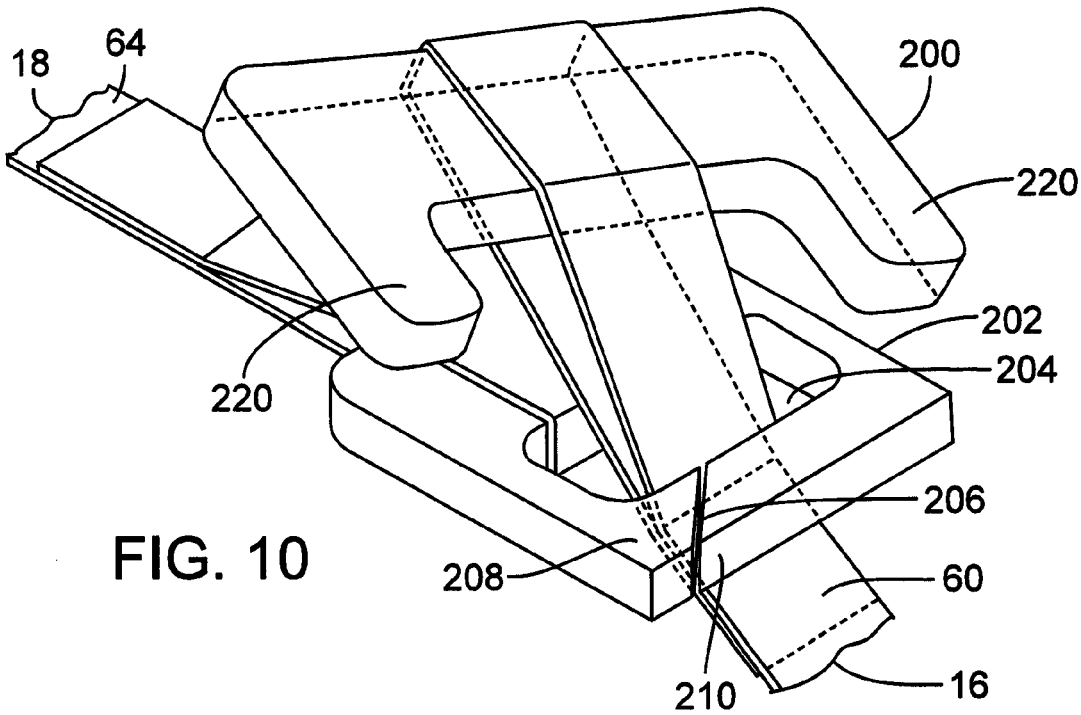
FIG. 10 is an illustration of a first splicing element secured to the trailing end portion of a running tape and a second splicing element secured to the leading end portion of a standby tape, shown just prior to the first splicing element engaging the second splicing element to form a splice, according to another embodiment.

FIG. 10 shows an alternative splicing apparatus comprising a first splicing element 200 secured to the trailing end portion 60 of the first tape 16 and a second splicing element 202 secured to the leading end portion 64 of the second tape 18. In FIG. 10, the tapes are shown just prior to the first splicing element 200 engaging the second splicing element 204 to form a splice. The first splicing element 200 can be secured to the trailing end portion 60 of the first tape in same manner as described for the splicing element 62 (FIGS. 2 and 3). For example, if adhesive tape is used, the first splicing element 200 is placed on the tape and the tape is folded back and adhered to itself so as to secure the splicing element between the two adjacent pieces of tape.

The first splicing element 200 in this embodiment has a generally U-shaped configuration, rather than the rectangular shape of splicing element 62 (FIGS. 2 and 3). Splicing element 200 has two leg portions 220 spaced from each other a distance greater than the width of splicing element 202 so that splicing element 202 can nest between the leg portions when splicing element 200 engages splicing element 202.

Splicing element 202 is formed with an opening 204 dimensioned large enough to permit passage of the first tape 16 but not splicing element 200. The leading end portion 64 of the second tape 18 is secured to the second splicing element 202 by inserting the end of the tape through the opening 204 and folding back and adhering the tape to itself as shown. A gap 206 between leg portions 208, 210 extends from an inner peripheral edge bounding the opening 204 to an outer peripheral edge of the splicing element 202. The gap 206 desirably is wide enough to allow the first tape 16 to be inserted through the gap 206 and into the opening. Instead of the illustrated gap 206, splicing element 202 can be formed with a slit between leg portions 208, 210 with the adjacent surfaces of the leg portions contacting each other. A gap between leg portions 208, 210 for inserting the first tape 16 into opening 204 can be created by bending or flexing one or both leg portions 208, 210, for example, by pulling the leg portions 208, 210 in opposite directions from each other.

In another embodiment, splicing element 202 can be formed with a separate slot or opening for securing the leading end portion 64 of the second tape 18.

In use, splicing element 202 (which is secured to the leading end portion 64 of the second tape 18) is placed around the first tape 16 while it is being dispensed by inserting the first tape 16 into the opening 204 via the gap 206. When splicing element 200 engages the second splicing element 202, the first and second tapes become linked, causing the first tape to pull the second tape into the downstream equipment. The second splicing element 202 should exhibit sufficient strength and rigidity at the desired dispensing speed to resist against deformation of leg portions 208, 210 caused by the pulling force of the splicing element 200 to maintain the splice. Because splicing element 202 nests between leg portions 220 of splicing element 200, leg portions 220 can engage the opposite sides of splicing element 202 and prevent separation of leg portions 208, 210 to assist in maintaining the splice.

Figure 11:
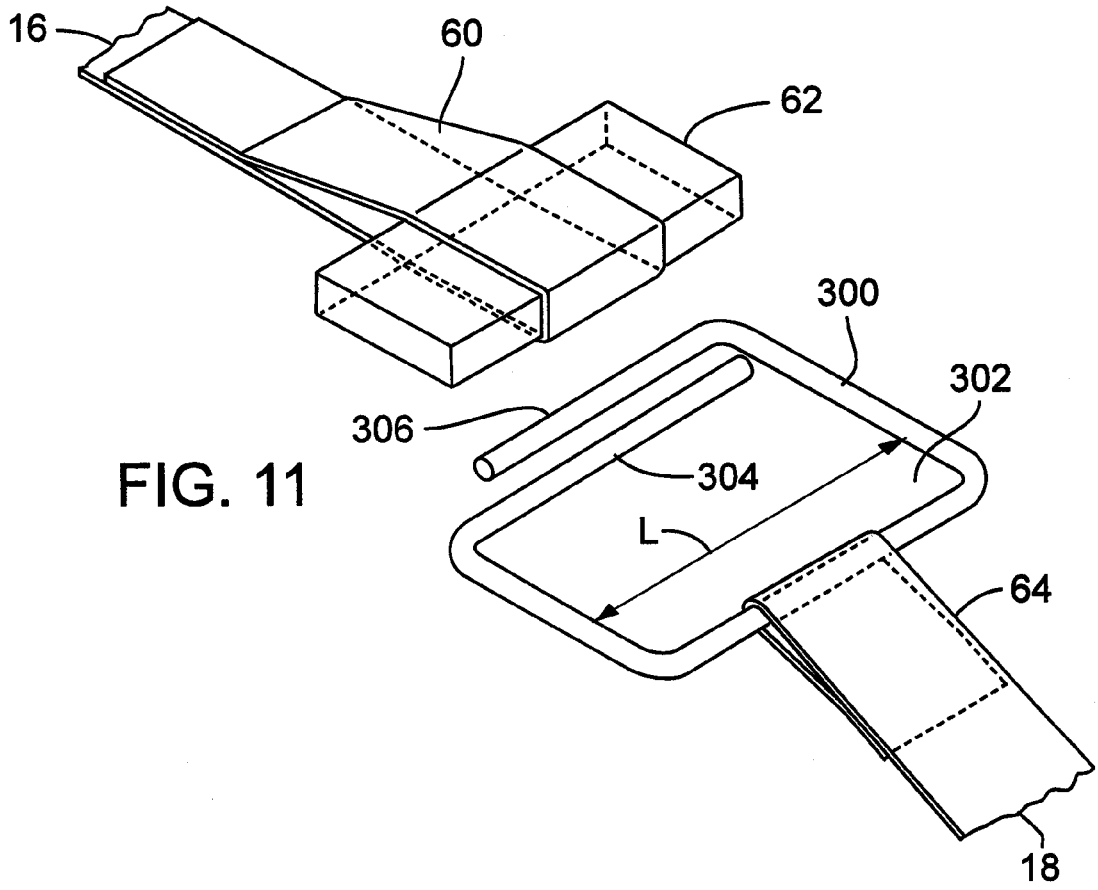
FIG. 11 is an illustration of a first splicing element secured to the trailing end portion of a running tape and a second splicing element secured to the leading end portion of a standby tape, according to another embodiment.
Figure 12:
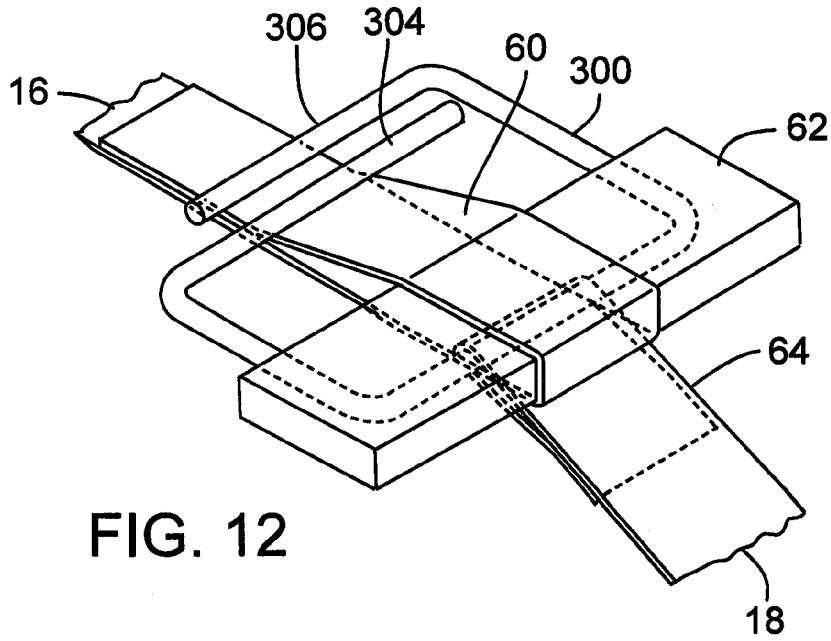
FIG. 12 is an illustration of the splicing elements of FIG. 11 showing the second splicing element placed around the running tape and being engaged by the first splicing element.

FIGS. 11 and 12 show a splicing element 300, according to another embodiment, for securing to the leading end portion 64 of the second tape 18. Splicing element 300 can be used in lieu of splicing element 66 (FIGS. 4-7), splicing element 100 (FIGS. 8 and 9), or splicing element 202 (FIG. 10). Splicing element 300 is formed from a wire defining a generally closed geometric shape having an opening 302 for receiving the first tape 16 and two overlapping end portions 304 and 306. As used herein, the term "wire" refers to a thin, elongated piece of material, and is not limited to metal wires. The length L of the opening 302 is sized to allow the first tape 16 to freely pass through the opening, but restrict passage of splicing element 62. In the illustrated embodiment, the splicing element 300 is generally rectangular. However, the splicing element 300 may comprise any other geometric shape, such as a square, triangle, trapezoid, oval, circle, or various combinations thereof. Splicing element 300 can be made from any of various suitable materials, such plastic, metal, composites, or combinations thereof.

The leading end portion 64 of the second tape 18 is secured to the splicing element 300 by inserting the end of the tape through the opening 302 and folding back and adhering the tape to itself as shown. To place splicing element 300 on a running tape (tape 16 in the illustrated embodiment), the end portions 304, 306 are separated from each other, such as by pulling or moving the end portions away from each, so as to form a gap between the end portions through which the running tape can be inserted.

Splicing element 300 is made of a flexible material, but yet exhibits sufficient strength and rigidity to maintain a splice at the desired dispensing speed. In one implementation, splicing element 300 can be made from a flexible, resilient material that has shape memory, such as plastic, such that the splicing element returns to its normal, closed shape (shown in FIGS.

11 and 12) after it is placed on a running tape. In alternative embodiments, splicing element 300 can be made from a material that has little or no shape memory. In such embodiments, after the splicing element is placed around a running tape, the end portions 304, 306 are bent back to the overlapping, closed position (depicted in FIGS. 11 and 12) by an operator.

The splicing element 300 can be used in combination with splicing element 62 as shown, or splicing element 200 (FIG. 10) for splicing a standby tape to a running tape.

Figure 13:
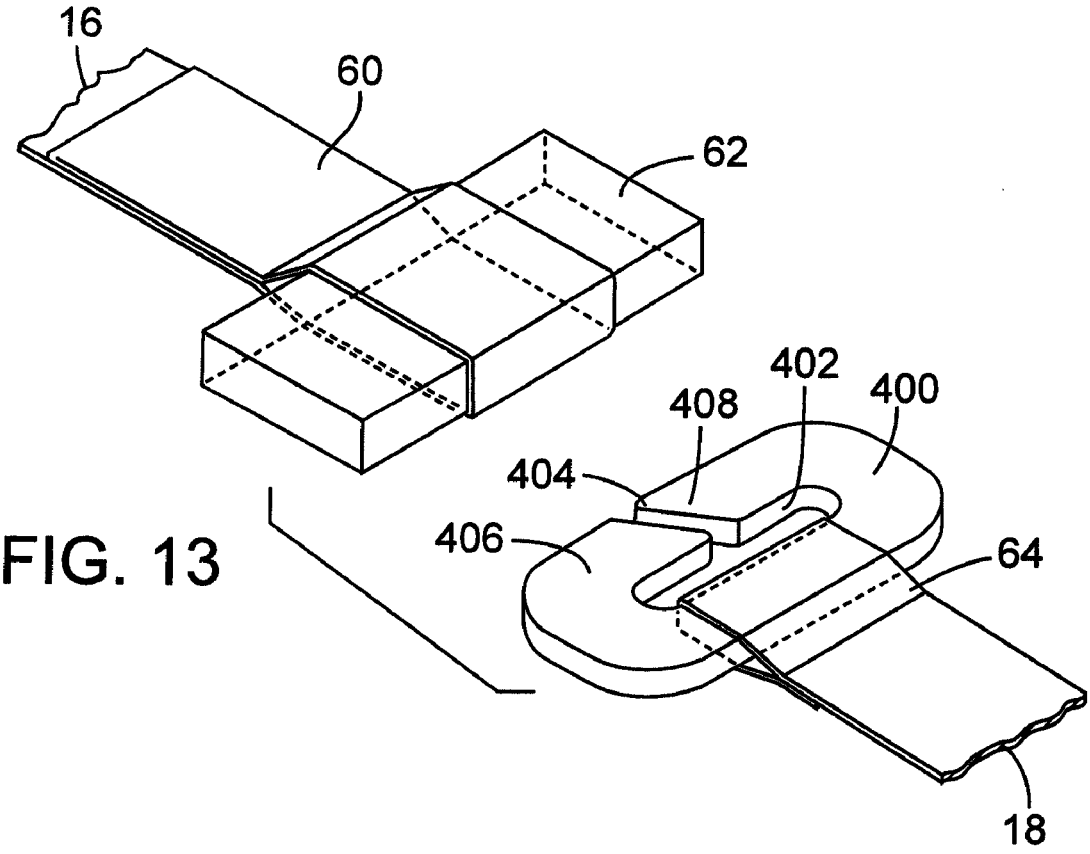
FIG. 13 is an illustration of a first splicing element secured to the trailing end portion of a running tape and a second splicing element secured to the leading end portion of a standby tape, according to another embodiment.
Figure 14:
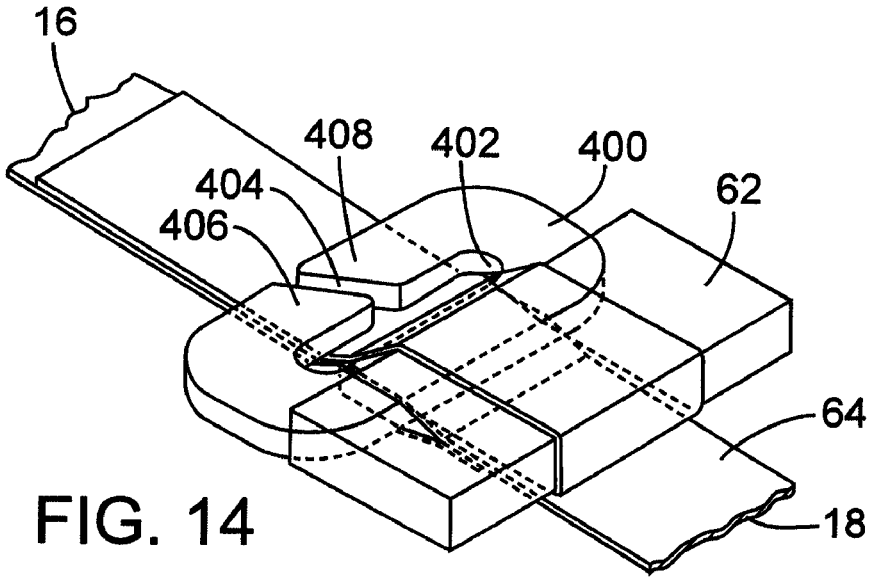
FIG. 14 is an illustration of the splicing elements of FIG. 13 showing the second splicing element placed around the running tape and being engaged by the first splicing element.

FIGS. 13 and 14 illustrate another embodiment of a splicing system comprising a first splicing element 62 and a second splicing element 400. Splicing element 400 is similar to splicing element 202 (FIG. 10), except that splicing element 400 is generally rectangular having curved or rounded corners extending between the sides of the splicing element. Providing the splicing element with rounded corners can help the splicing element avoid becoming caught on surrounding equipment or materials as the tape is dispensed. Splicing element 400 is formed with an opening 402 dimensioned large enough to permit passage of the first tape 16 but not splicing element 62.

A gap 404 formed between end portions 406, 408 extends from an inner peripheral edge bounding the opening 402 to an outer peripheral edge of the splicing element 400. The gap 404 desirably is wide enough to allow the first tape 16 to be inserted through the gap 404 and into the opening 402. The gap 404 desirably extends diagonally from the inner peripheral edge to the outer peripheral edge of the body as shown. In this manner, it is more difficult for the first tape 16 to pull through the gap 404 after a splice is formed.

In an alternative embodiment, an identical splicing element 400 can be secured to the trailing end portion 60 of the first tape 16, in lieu of splicing element 62. In this way, a manufacturer would only need to supply one type of splicing element which can be used at the trailing and leading end portions of the tape rolls. Also, due to its enclosed shape, splicing element 400 is less likely to be inadvertently removed from the trailing end portion 60 of the first tape 16 than splicing element 62.

In particular embodiments, splicing element 400 is made of plastic and has an overall thickness in the range of about 10 to 125 thousandths of an inch (about 0.01 to 0.125 inch), and more desirably in the range of about 50 to 100 thousandths of an inch (about 0.05 to 0.10 inch).

Figure 15:
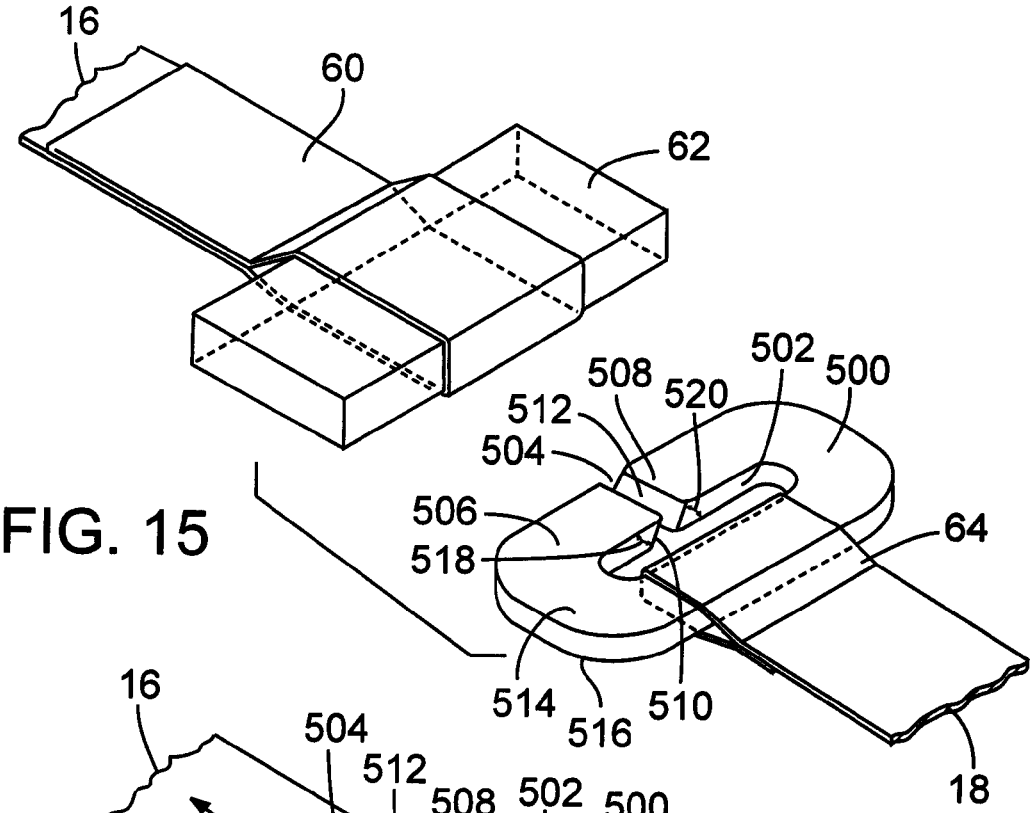
FIG. 15 is an illustration of a first splicing element secured to the trailing end portion of a running tape and a second splicing element secured to the leading end portion of a standby tape, according to another embodiment.
Figure 16:
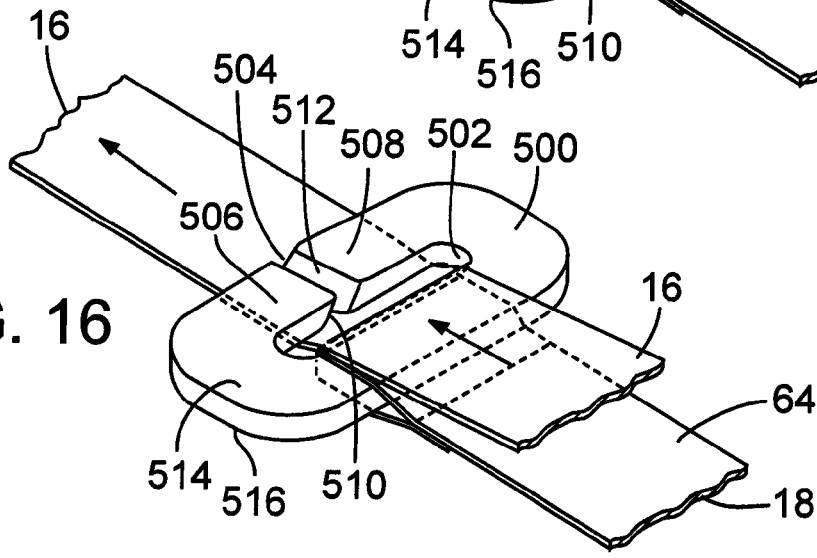
FIG. 16 is an illustration showing the second splicing element of FIG. 15 placed around the running tape.
Figure 17:
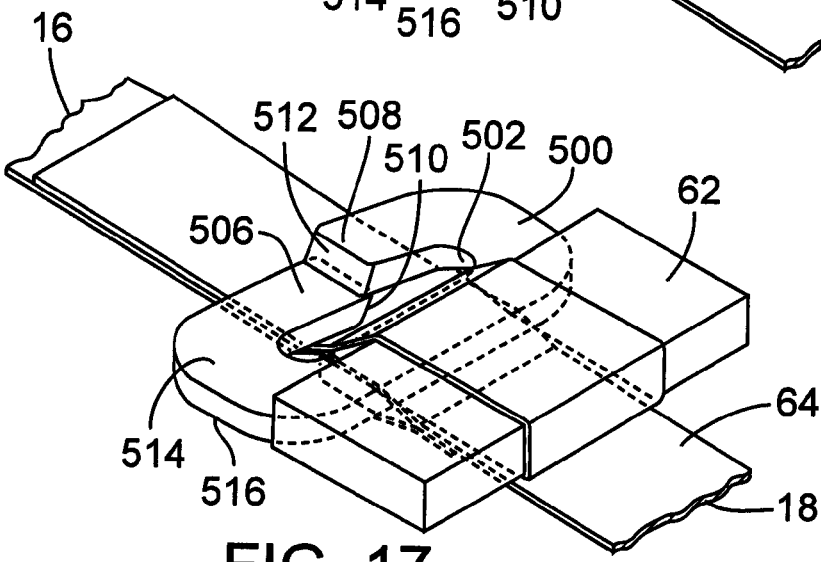
FIG. 17 is an illustration showing the second splicing element of FIG. 15 after its leg portions are placed in an overlapping configuration so as to completely encircle the running tape.

FIGS. 15-17 illustrate another embodiment of a splicing system comprising a first splicing element 62 and a second splicing element 500. Splicing element 500 in the illustrated configuration has an overall shape that is similar to that of splicing element 400 (FIGS. 13 and 14), although splicing element 500 can have various other geometric shapes. Splicing element 500 is formed with an opening 502 dimensioned large enough to permit passage of the first, running tape 16 but not splicing element 62.

A gap 504 formed between end, or leg, portions 506, 508 of the splicing element extends from an inner peripheral edge bounding the opening 502 to an outer peripheral edge of the splicing element 500. The gap 504 desirably is wide enough to allow the first tape 16 to be inserted through the gap 504 and into the opening 502. The leg portions 506, 508 have respective, spaced-apart end surfaces 510, 512 defining the gap 504. As shown, the end surfaces 510, 512 extend diagonally (i.e., non-perpendicular) with respect to the opposing major surfaces 514, 516 of the splicing element (the "upper" and "lower" surfaces of the splicing element). End surface 510 forms an acute angle 518 with respect to the upper surface 514 and end surface 512 forms an acute angle 520 with respect to the lower surface 516. In the illustrated configuration, angles 518 and 520 are equal to each other and end surfaces 510, 512 extend in a mutually parallel relationship relative to each other. In other embodiments, angles 518, 520 can be different from each other.

Although the width of the gap 504 and the angles 518, 520 can vary, these dimensions are selected such that the leg portions 506, 508 can be moved against each other in opposite directions until one leg portion slides past the other to cause the leg portions to "snap" in place with one leg portion overlapping and contacting the other leg portion (as shown in FIG. 17). Generally, as the angles 518, 520 are increased, the width of the gap 504 is decreased, and as the angles 518, 520 are decreased, the width of the gap 504 is increased.

In use, splicing element 500 is placed around the running tape 16 by inserting the tape in the opening 502 via the gap 504 (FIG. 16). The leg portions 506, 508 are then moved against each other in opposite directions until the leg portions "snap" into place such that they overlap and contact each other at their adjacent ends, as depicted in FIG. 17. In this position, the leg portions 506, 508 completely surround the running tape 16 and the gap 504 is essentially eliminated to assist in retaining the running tape 16 within the opening 502 after a splice is formed.

In particular embodiments, splicing element 500 is made of plastic and has an overall thickness in the range of about 10 to 125 thousandths of an inch (about 0.010 to 0.125 inch), and more desirably in the range of about 50 to 100 thousandths of an inch (about 0.05 to 0.10 inch). The width of the gap 504 is in the range of about 30 to 45 thousandths of an inch (about 0.030 to 0.045 inch). The end surfaces 510 and 512 are parallel to each other and the angles 518, 520 are in the range of about 30 to 45 degrees.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

We claim:

1. An apparatus comprising:

a first, running spool of tape having a trailing end portion and a first splicing element secured to the trailing end portion;

a second, stand-by spool of tape having a leading end portion and a second splicing element secured to the leading end portion; and wherein the second splicing element comprises a shape-memory material and has at least one aperture sized to receive the tape from the first spool and first and second leg portions bounding at least a portion of the aperture, whereby the tape being dispensed from the first spool can be introduced into the aperture by inserting the tape through a gap defined between the leg portions;

wherein when the tape from the first spool is inserted in the aperture and the first spool becomes depleted of tape, the first splicing element engages the second splicing element so as to splice the tape from the first spool to the tape from the second spool;

wherein the leg portions can be bent between a first position in which the leg portions are spaced apart from each other and the tape from the first spool can be inserted into the aperture via the gap and a second position in which the leg portions are placed in contact with each other in an overlapping relationship so as to completely enclose the aperture in the second splicing element, wherein the leg portions are configured such that they are normally biased toward the first position and the contact between the leg portions in the overlapping relationship resists movement of the leg portions back toward the first position while tape from the first spool is being dispensed through the aperture.

2. The apparatus of claim 1, wherein the first splicing element extends transversely across the tape of the first spool and has a length longer than the length of the aperture in the second splicing element.

3. The apparatus of claim 1, wherein the second splicing element is made of a flexible, resilient material.

4. The apparatus of claim 3, wherein the second splicing element is made of plastic.

5. The apparatus of claim 1, wherein the leading end portion of the second tape comprises a loop extending through another aperture in the second splicing element.

6. The apparatus of claim 1, wherein the second splicing element comprises opposing, first and second major surfaces, the first and second leg portions have first and second end surfaces, respectively, wherein the gap is defined between the first and second end surfaces, which are parallel to each other and non-perpendicular to the first and second major surfaces.

7. The apparatus of claim 1, wherein the first and second leg portions have first and second end surfaces, respectively, the gap is defined between the first and second end surfaces, and the leg portions are configured such that the end surfaces are spaced apart and do not contact each other in the first and second positions.

8. A method of splicing a first, running tape to a second, stand-by tape, the first tape having a trailing end portion and a first splicing element secured to the trailing end portion, the second tape having a leading end portion and a second splicing element secured to the leading end portion, the second splicing element having at least one opening sized to receive the first tape and comprising a shape-memory material, the method comprising:

inserting the first tape into the opening of the second splicing element, such that the first tape can pass through the opening and the first splicing element can engage the second splicing element to splice the first tape to the second tape;

wherein the second splicing element comprises two substantially parallel leg portions and a gap defined therebetween, the leg portions being normally biased toward a first, undeflected position, and inserting the first tape into the opening comprises inserting the first tape into the opening via the gap; and closing the gap between the leg portions after inserting the first tape into the opening;

wherein each leg portion has an end portion and closing the gap between the leg portions comprises bending one leg portion relative to the other to place the end portions in contact with each other in second, overlapping position, wherein the contact between the leg portions in the overlapping relationship resists movement of the leg portions back toward the first position while the first tape passes through the opening in the second splicing element.

9. The method of claim 8, wherein the second splicing element is received between two spaced-apart leg portions of the first splicing element when the first splicing element engages the second splicing element.

10. The method of claim 8, wherein the second tape is supplied from a stationary roll of tape that begins rotating from a stationary position after the first splicing element engages the second splicing element.

11. The method of claim 8, further comprising dispensing the first tape from a first tape roll at a rate of at least 1,100 feet per minute and, after the first tape is spliced to the second tape, dispensing the second tape from a second tape roll at a rate of at least 1,100 feet per minute.

12. The method of claim 8, further comprising dispensing the first tape from a first tape roll at a rate of at least 1,400 feet per minute and, after the first tape is spliced to the second tape, dispensing the second tape from a second tape roll at a rate of at least 1,400 feet per minute.

13. The method of claim 8, wherein the second splicing element is substantially flat when the leg portions are in the first position.

14. The method of claim 8, wherein the end portions do not contact each other when the leg portions are in the first position.

15. A splicing element for use in splicing a first, running tape being dispensed from a tape dispensing device to a second, standby tape, the splicing element comprising a shape-memory material formed with at least one aperture sized to receive the first tape, and a peripheral portion bounding at least a portion of the aperture, whereby the first tape can be introduced into the aperture by inserting the first tape through a gap in the peripheral portion while the first tape is being dispensed by the dispensing device;

the splicing element further comprising opposing, first and second major surfaces, and wherein the peripheral portion comprises first and second leg portions bounding the aperture and having first and second end surfaces, respectively, wherein the gap is defined between the first and second end surfaces, which are parallel to each other and non-perpendicular to the first and second major surfaces, wherein the leg portions are normally biased toward a first, undeflected position and can be moved to a second position in which the leg portions overlap and contact each other at their adjacent ends to assist in retaining the running tape within the aperture when splicing the running tape to the standby tape, wherein the leg portions are configured such that the contact between the leg portions in the overlapping position resists movement of the leg portions back toward the first, undeflected position.

16. The splicing element of claim 15, further comprising at least one slot sized to receive the second tape and spaced from the aperture.

17. The splicing element of claim 15, wherein the gap extends diagonally from the at least one aperture to the outer peripheral edge of the splicing element.

18. The splicing element of claim 15, wherein the splicing element comprises a generally rectangular body with rounded corners.

19. The splicing element of claim 15, wherein the end surfaces of the leg portions do not contact each other when the leg portions are in the first, undeflected position.

20. A roll of tape comprising:

a trailing end portion;

a leading end portion;

a first splicing element secured to the trailing end portion; and a second splicing element secured to the leading end portion, the second splicing element comprising a body formed from a shape-memory material and having at least one aperture sized to receive a running tape dispensed from another tape roll, and a peripheral portion bounding at least a portion of the aperture, whereby the running tape can be introduced into the aperture by inserting the running tape through a gap in the peripheral portion;

wherein the peripheral portion comprises two leg portions and the gap is defined between the leg portions, the leg portions being configured such that they are normally biased toward a first, undeflected position;

wherein one of the leg portions can be bent relative to the other leg portion to place the end portions of the leg portions in a second, overlapping position so as to close the gap in the second splicing element such that contact between the leg portions in the overlapping position resists movement of the leg portions back toward the first, undeflected position.

21. The roll of tape according to claim 20, wherein the first and second splicing elements have the same shape.

22. The roll of tape according to claim 20, wherein each leg portion has a respective upper and lower surface and an end surface, the end surface being non-perpendicular to the upper and lower surface.

23. The roll of tape according to claim 20, wherein the second splicing element is made of a plastic.

24. The roll of tape according to claim 20, wherein the body of the second splicing element is generally rectangular with rounded corners.

25. The roll of tape according to claim 20, wherein the leg portions have respective end portions that do not contact each other when the leg portions are in the first position and that are placed in contact with each other when the leg portions are in the second position.

* * * * *